United States Patent [19]

Döring et al.

[11] Patent Number: 5,058,938

[45] Date of Patent: Oct. 22, 1991

[54] DRIVE-ROD LOCK

[75] Inventors: Ralf Döring, Heiligenhaus; Klaus Korb, Ratingen, both of Fed. Rep. of Germany

[73] Assignee: Carl Fuhr GmbH & Co., Heiligenhaus, Fed. Rep. of Germany

[21] Appl. No.: 498,001

[22] Filed: Mar. 23, 1990

[51] Int. Cl.[5] ..... E05C 9/12

[52] U.S. Cl. ..... 292/45; 292/335

[58] Field of Search ..... 292/336, 333, 332, 335, 292/45, 39, 336.3

[56] References Cited

U.S. PATENT DOCUMENTS 2,293,363 8/1942 Schall ..... 292/335 X 4,063,763 12/1977 Van Herpen ..... 292/39

*Primary Examiner*—Richard E. Moore

*Attorney, Agent, or Firm*—Martin A. Farber

[57] ABSTRACT

A drive-rod lock has drive rods which can be displaced by turning a door handle or the like, and a nut associated with the door handle. The nut, held in its basic central position, can be swung out of that position against spring action in the opposite direction. The lock case bears a cuff rail which continues beyond the lock case into freely extending cuff-rail sections behind which there are guided drive rods. The drive rods control additional lock members, for instance swivel bolts, arranged in the region of the cuff-rail sections. These locking members operate both by the turning of the door handle and as a result of release of at least one force accumulator acting on the drive rods. Operation is obtained by means of a release which is actuated upon the closing of the door by the frame, or the like, and for a favorable positioning of the release even with a small depth of the drive-rod lock. The release (62) and/or the force accumulator (55) are arranged behind the freely extending cuff-rail sections (1').

13 Claims, 10 Drawing Sheets

DRIVE-ROD LOCK

FIELD AND BACKGROUND OF THE INVENTION

The present invention relates to a drive-rod lock having drive rods which can be displaced by turning the door handle or the like, and a nut associated with the door handle, which nut, when held in its basic central position, can be swung out of that position against spring action in opposite directions, the lock case bearing a cuff rail which continues beyond the lock case into freely extending cuff-rail sections behind which there are guided the drive rods which so control additional locking members, for instance swivel bolts arranged in the region of the cuff-rail sections, that these locking members can enter into mating locking parts on the frame side both as a result of the turning of the door handle and of the releasing of at least one force accumulator acting on the drive rods, the releasing of the force accumulator being effected by means of a release actuated upon, the closing of the door, by the frame or the like.

A drive-rod lock of the type in question in which the release is developed in the form of a one-armed lever and is mounted directly below the catch of the drive-rod lock on the outside of the cuff is known on the market. Furthermore a bolt extends over the one-armed swing lever at its free end. On the inside of the door, the swing lever is connected, fixed for rotation, to a blocking lever which, in its turn, cooperates with a slide by which upon the return movement of the catch by door handle actuation, cocks compression springs which are arranged in the lock housing. This development is expensive in construction. It furthermore requires extensive construction space so that, as a whole, large lock cases result. Their field of use is limited. Thus such drive-rod locks are not suited for installation in tubular frame doors where only little installation space is available for the drive-rod lock. Furthermore, swing lever and bolt extend beyond the cuff rail on the outside and constitute a not inconsiderable projection which proves disadvantageous, upon for instance the cleaning of the door.

SUMMARY OF THE INVENTION

It is the object of the present invention so to develop a drive-rod lock of the type in question in a manner simple to manufacture that with only slight depth of the drive-rod lock the release can be positioned at a favorable place.

This object is achieved in accordance with the invention by the fact that the release (62) and/or the force accumulator (55) are arranged behind the freely extending cuff-rail sections (1').

The ensuing description sets forth advantageous further developments of the inventive solution.

In accordance with this development, there is disclosed a drive-rod lock of the type in question which is of increased utility. The force accumulator itself need no longer be installed in the lock housing. The release can also be arranged outside the lock housing so that a drive-rod lock of small dimensions can be produced while obtaining a small depth of installation of the lock which proves advantageous, for instance, upon installation in tubular frame doors. Both the force accumulator and the release can be provided at any place at the rear of the free protruding cuff-rail sections. This, therefore, also increases the field of use of such a drive-rod lock. It can be installed both with and without force accumulator.

If the force accumulator and the release are absent, then the locking of the door must be effected in the customary manner. However, if the force accumulator and the release are provided, then the locking members enter into their locking position already upon the closing of the door. The loading of the force accumulator then takes place upon the opening movement by actuation of the door handle. Since the release need not be provided in the region of the drive-rod lock, it can be arranged on the cuff-rail section in such a position that it does not form a disturbing projection. A favorable arrangement is therefore assured also with respect to the force accumulator.

The cuff-rail sections and/or drive rods can form bends with formation of a chamber for receiving the force accumulator, developed as a compression spring. If required, several such chambers can be provided so that a predetermined force accumulator can always be realized. This development also serves the purpose of use of coupling the drive rods via corner deflections and of providing locking members on the horizontal drive rod sections. There is always sufficient force to bring the corresponding locking members into their locking position. If this is not the case, for instance in the event of a warped door, then the locking force can be further increased by displacement of the door handle in a direction opposite that of normal door handle actuation. The swing lever which is provided with the feeler member is then also arranged in concealed position. Only the feeler member protrudes beyond the cuff-rail section, so that the projecting parts are reduced to a minimum.

Since the swing lever can be swung towards both sides, out of its central position, which corresponds to the blocking of the force accumulator, transverse to the longitudinal direction of the cuff-rail sections, into one release position each, the same development can be provided both for right-hung and for left-hung doors. As soon as the feeler member is acted on on the door-frame side upon the closing of the door, the swing lever passes out of its blocking position and releases the force accumulator while driving the drive rods which, in their turn, bring the locking members into the locking position. Upon the retraction of the drive rods due to displacement of the door handle, the swing lever can always return into the central position due to the compression spring acting on it, which results in the locking position. In this position the swing lever rests with its projection which extends transverse to its longitudinal direction against the throat of the abutment seated on the drive rod. Therefore a detent force must be overcome in order to have the force accumulator enter into action.

It is favorable from an operating standpoint that the swing lever, which is mounted on the cuff-rail section, is developed with two arms. One lever arm forms the projection, and the tension spring can act on the other lever arm. A simple development of the release is obtained if the feeler member is developed as a pin. For the pin there must merely be provided an arcuate slot located concentric to the fulcrum of the swing lever in the cuff rail section. The arcuate slot fulfills a further function by providing support for the feeler member. In addition to this, advantages result with respect to the development of the drive-rod lock itself. The structural parts which hold the nut in its basic central position can be arranged in a spatially favorable manner. They, together with the nut, can be assembled as an external installation unit in order then to install them in the lock housing, which results in low installation costs for the drive-rod lock.

This installation unit furthermore makes it possible to manufacture drive-rod locks with small or widened mandrel dimension. The compression spring holds the actuating arm, the slide and the auxiliary slide together as one structural unit by means of the coupling pin in the manner that the claw-shaped end of the actuating arm is clamped between the end surface of the slide and the coupling pin. If a swinging motion of the actuating arm takes place in the one direction, then the auxiliary slide is carried along by the coupling pin against the force of the compression spring. Displacement of the actuating arm in the other direction, on the other hand, leads to direct action on the slide by the claw-shaped end, together with a compression of the compression spring from the other side. This means that the actuating arm is acted on either by a pulling or pushing action.

The claw-like engagement below the coupling pin also leads to advantages from an assembly standpoint. The combining of auxiliary slide, slide and actuating arm with the compression spring to form a structural unit is favored by the mandrel which extends from the auxiliary slide, which, in space saving manner, extends through both the compression spring and the slide and surrounds the pin with its yoke-shaped end. Due to the fact that the slide receives part of the length of the compression spring, the latter is stabilized against kinking. It also is, in this case, arranged in protected manner within the corresponding structural member. In order that the coupling pin is not carried along upon displacement of the actuating arm, it strikes against the one end of the arcuate slot in the lock housing. The claw-shaped end then presses against the slide and displaces the latter against the force of the compression spring.

When the swinging motion of the actuating arm takes place in the other direction, displacement of the slide is blocked by the mating stop edge, which is opposite the stop edge of the slot. If the actuating arm is developed with two arms, then the one arm forms the claw-shaped end, and the other arm serves as the lever to which the link plate coupled to the nut is attached. It is evident from the above that the prefabricated installation unit can be substantially adapted to structural circumstances in the manner that this installation unit can be arranged in the lock housing at any angle.

Furthermore, the adjustability of the length of the mandrel has installation advantages. Simultaneously with adjustment of the mandrel length, the pretensioning of the compression spring is also changed. The adjustment of the mandrel length can take place, for instance, by thread adjustment. The end of the mandrel attached to the auxiliary slide is then provided with an external thread and the auxiliary slide with an internal thread. After the assembling of the coupling pin, actuating arm and slide, and the placing on of the compression spring, the auxiliary slide need only be screwed on, this being in simple manner, an adjusting of the compression spring to the corresponding tension.

BRIEF DESCRIPTION OF THE DRAWINGS

The invention will be further explained below, with reference to the attached drawing, which shows one embodiment and in which.

DETAILED DESCRIPTION OF THE PREFERRED EMBODIMENT

Figure 1:
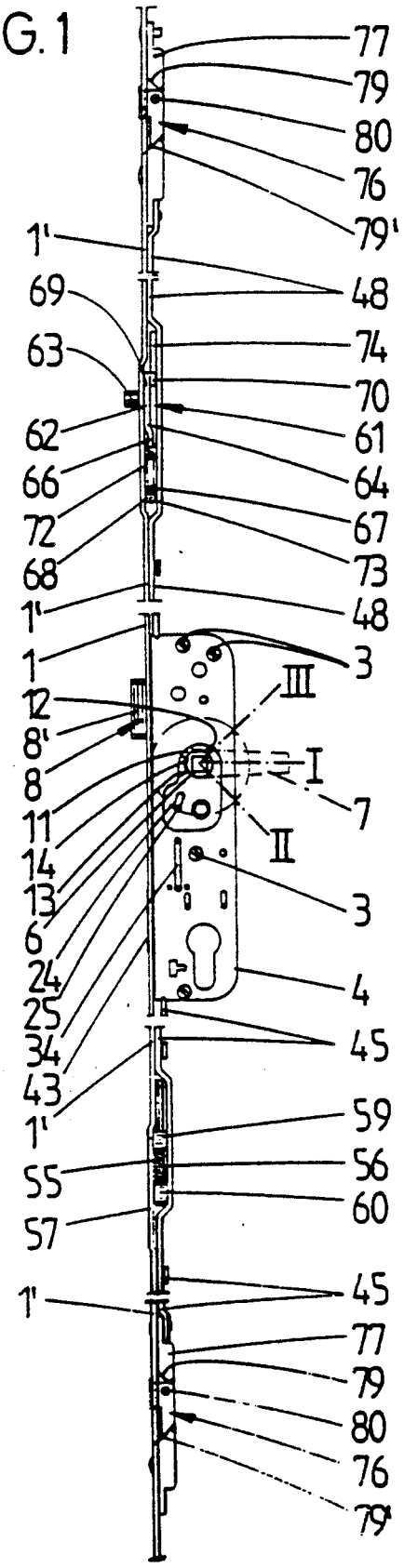
FIG. 1 is a view of the drive-rod lock with the door open, the force accumulator loaded and the locking members introduced into the cuff-rail sections.
Figure 2:
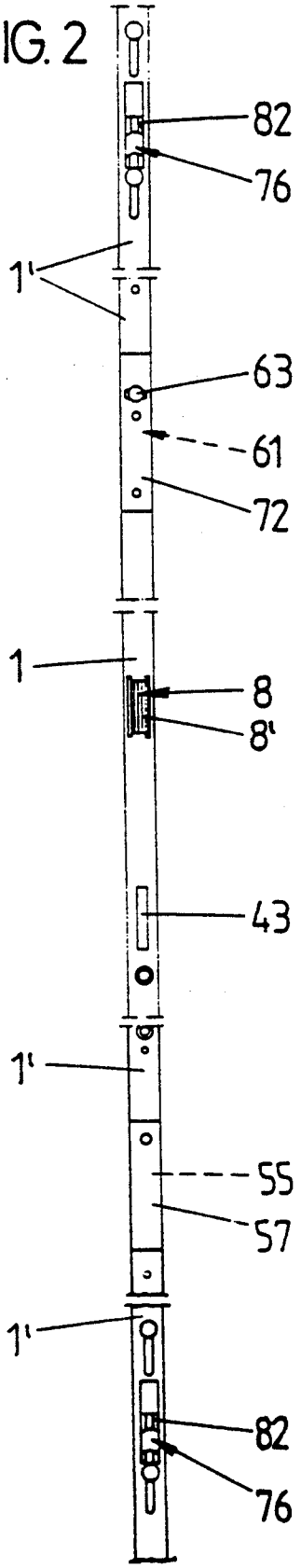
FIG. 2 is a rotated view of FIG. 1.

The drive-rod lock has a cuff rail 1 to which a lock bottom 2 is attached at a right angle. Parallel to said lock bottom there is a lock cover 4, attached by screws 3 which engage in stud bolts 5 on the lock-bottom side. The cuff rail 1 extends beyond the lock housing into freely protruding cuff-rail sections 1'.

In the upper region of the lock housing, a nut 6 is mounted in the lock bottom 2 and the lock cover 4 to receive a door handle 7, indicated in dash-dot line in FIG. 1. When the door handle assumes its horizontal position I, this corresponds to the basic central position. The position indicated by the line II is the position in which the nut 6 retracts a latch 8. The latter consists of a latch head 8' and a latch tail 8". The latch head 8' is guided in the cuff rail 1 while the latch tail 8" is guided on the lock-bottom side. A leg spring 9 acts on the latch tail 8" and urges the latch 8 in outward direction. The latch tail 8" is acted on by a nut arm 10 of the nut 6. The nut 6 is furthermore provided with a rotation-limiting stop 11 which extends from the nut arm 10 and cooperates with stop edges 12, 13 of an arcuate opening 14 in the lock cover 4, so that the door handle positions II and III are thereby imparted a stop limitation. The door handle positions II and III form an angle of about 90° between themselves, so that the door handle can swing 45° in both directions out of its horizontal position I.

A further arm 15 extends from the nut 6 at right angle to the latch actuation arm 10. A link plate 17 engages there by means of a pivot pin 16, the link plate being coupled, in its turn, via a pivot shaft 18 to the second arm 19 of an actuating arm 20. The latter is mounted below the nut 6 around a linking pin 21 on the lock-housing side. The first arm 22 opposite the second arm 19 forms a claw-shaped end 23 which engages under a coupling pin 25 guided in an arcuate slot 24 in lock bottom 2 and lock cover 4. At the height of the claw-shaped end 23, the coupling pin 25 is surrounded by a yoke 26 which extends into a downward directed mandrel 27 which extends approximately parallel to the cuff rail 1. At its end, the mandrel 27 has a threaded section 28. The latter engages into an internal thread of a pin-shaped centering projection 29 of an auxiliary slide 30. A guide projection 31 extending from said auxiliary slide extends into an approximately vertically extending longitudinal slot 32 in the lock bottom 2. Opposite the guide projection 31, a groove 33 is provided on the auxiliary slide 30, an inward-depressed rib 34 of the lock cover 4 extending into said nut 33. This rib 34 extends parallel to the direction of the longitudinal slot 32, whereby the auxiliary slide 30 is imparted exact guidance. The upper end of the longitudinal slot 32 forms a counter stop edge 35, opposite which, at a certain distance away, there is the stop edge 36 of the arcuate slot 24. The coupling pin 25 is pulled against this stop edge 36 by a compression spring 37 which urges the auxiliary slide 30 in downward direction and surrounds the centering projection 29 and thus also receives the mandrel 27.

The mandrel 27 extends through a slide 38. This slide forms, at its upper end, a projection 39, which extends into the longitudinal slot 32. The lower end of the slide 38 facing the lock cover 4 is also provided with a groove 40, into which the rib 34 extends. The slide 38 receives only a part of the length of the compression spring 37 and, at the level of the projection 39, has a supporting surface 41 for the facing end of the compression spring 37. As a result of the above-described development, the claw-shaped end 23 of the actuating arm 22 is clamped between the upper end surface 42 of the slide 38 and the coupling pin 25, so that actuating arm 20, mandrel 27, auxiliary slide 30, compression spring 37 and slide 38 form a coherent structural unit which can be inserted as a whole into the lock. This structural unit may also include the articulated plate 17 and the nut 6, so that a coherent, easily assembled chain is obtained. This development makes it possible to arrange the coherent structural unit in different alignments within the lock housing of a drive-rod lock. The guide slots merely have to be provided in the corresponding position.

Another component of the drive-rod lock consists of a bolt 43 arranged below the above-described structural unit, a bolt keeper 44 which is spring-loaded in downward direction being associated with said bolt 43. The bolt 43 extends through a lower drive rod 45 of the drive-rod lock. This drive rod 45 extends on the inside of the cuff rail 1 and the lower cuff-rail section 1' and is provided at the height of the actuating arm 20 with a tooth-strip section 46. Adjacent this section, the drive rod 45 is in form-locked engagement with a drive rod connecting piece 47 which can be displaced parallel to the cuff rail 1 and from which an upper drive rod 48 extends.

The displacement of the drive rods 45, 48 is effected by a double-armed toothed segment 51 which is also mounted for rotation on the pivot pin 21. The one arm forms a toothing 52 which is in engagement with the tooth-strip section 46. Both arms of the toothed segment 51 are provided with diametrically opposite arcuate slots 53, 54. The articulated shaft 18 between link plate 17 and the second arm 19 extends into the arcuate slot 53. In the open position of the drive-rod lock, i.e. when the door is open, the articulated shaft 18 is at the upper end of the arcuate slot 53. The other arcuate slot 54 is passed through by the coupling pin 25 which, in this position, is at the lower end of the arcuate slot 54. An idle stroke is therefore created between actuating arm 20 and toothed segment 51.

On the rear side of the lower cuff-rail section 1' there is provided a force accumulator 55, developed as compression spring. The force accumulator extends in a receiving chamber 56 which is formed by oppositely directed bends 57 and 58 of the lower cuff-rail section 1' and of the lower drive rod 45. The force-accumulator compression spring 55 is supported on one end by the projection 59 riveted to the cuff-rail section 1'. At the other end, opposite the projection 59, an abutment 60 is attached to the drive rod 45. When the drive rod 45 moves in upward direction, the force accumulator 55 is loaded via the abutment 60.

A detent device 61 arranged above the lock housing and behind the upper cuff-rail section 1' serves to secure the loaded position of the force accumulator 55. The detent device has a release 62 which is formed by a swing lever 64 equipped with a feeler member 63. The swing lever 64 is double-armed. Its pivot pin 65 is seated on the upper cuff-rail section 1'. A tension spring 67 acts on the shorter lever arm 66, the tension spring, in its turn, being fixed in position on a pin 68 provided in the center of the cuff-rail section. The pivot pin 65 is also located in the center of the cuff rail. The swing lever 64 is thus urged in the direction of its central position. The other, longer lever arm 69 tapers towards its free end and forms at that place a projection 70 which extends transverse to its longitudinal direction. The end of the projection 70 is rounded.

Figure 7:
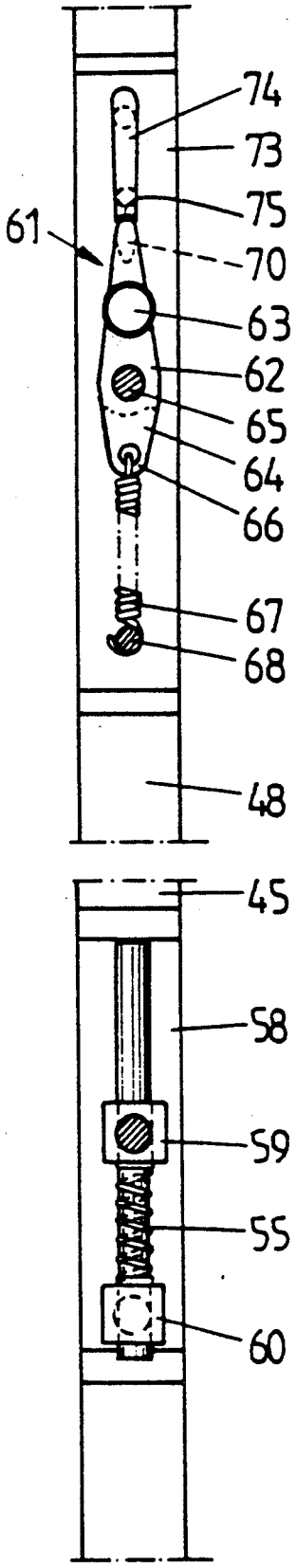
FIG. 7 is a view of the release device and the force accumulator, the cuff-rail sections being omitted.

In the region between the projection 70 facing away from the cuff rail 1 and the pivot pin 65, the pin-shaped feeler member 63 is attached to the lever arm 69, the feeler member passing through and protruding beyond a curved slot 71 in the cuff-rail section 1', which slot extends concentric to the fulcrum of the swing lever. As shown, in particular, in FIG. 7, projection 70, feeler member 63, pivot pin 65 and the point of attack of the tension spring 67 are arranged in a line which coincides with the longitudinal center line of the cuff-rail section 1'. In the region of the swing lever 64 and the tension spring 67, the freely protruding cuff-rail section 1' is also provided an outward bend 72, which is directed opposite the direction of the outward bend 73 of the upper drive rod 48.

In the upper region of the bend 73 and on the inside of the bend, an abutment 74 is attached to the cuff-rail section 1'. The abutment is elongated in the manner that its central longitudinal line extends parallel to the longitudinal center of the drive rod 48. The abutment 74 tapers towards its lower end and forms there a throat 75 which is adapted to the end rounding of the projection 70 of the release 62. When the force accumulator 55 is loaded, the projection 70 rests in the throat 75 of the abutment 74 and thus prevents the force accumulator 55 from unloading. Movement of the drive rods 45, 48 in downward direction is therefore not possible. The lock ward remains therefore in open position of the door in the position shown in FIG. 3.

On the other side of the release 62 and the force accumulator 55, additional locking members 76 are provided in the region of the cuff-rail sections 1'. They are developed as swivel bolts in the embodiment shown. The control of the swivel bolts 76 is effected by both the upper drive rod 48 and the lower drive rod 45. For the sake of simplicity, only the control of the lower swivel bolt 76 by the lower drive rod 45 will be explained. The lower drive rod 45 has a driver 77, which has a central recess 78. The latter is elongated in the manner that the narrow edges 79, 79' diverge towards the cuff-rail section 1'. In the upper region of the recess 78, a bearing pin 80 is provided for the single-arm swivel bolt 76. In the loading position of the force accumulator 55, the swivel bolt 76 is retracted. Its roof-shaped engagement end 81 then extends in an outlet opening 82 of the cuff-rail section 1'. The transverse edges 83 and 84 of the outlet opening 82 form control surfaces for the swivel bolt 76 which has corresponding mating control surfaces 85, 86. In the open position of the swivel bolt 76, the mating control surface 86 rests against the narrow edge 79'.

Figure 3:
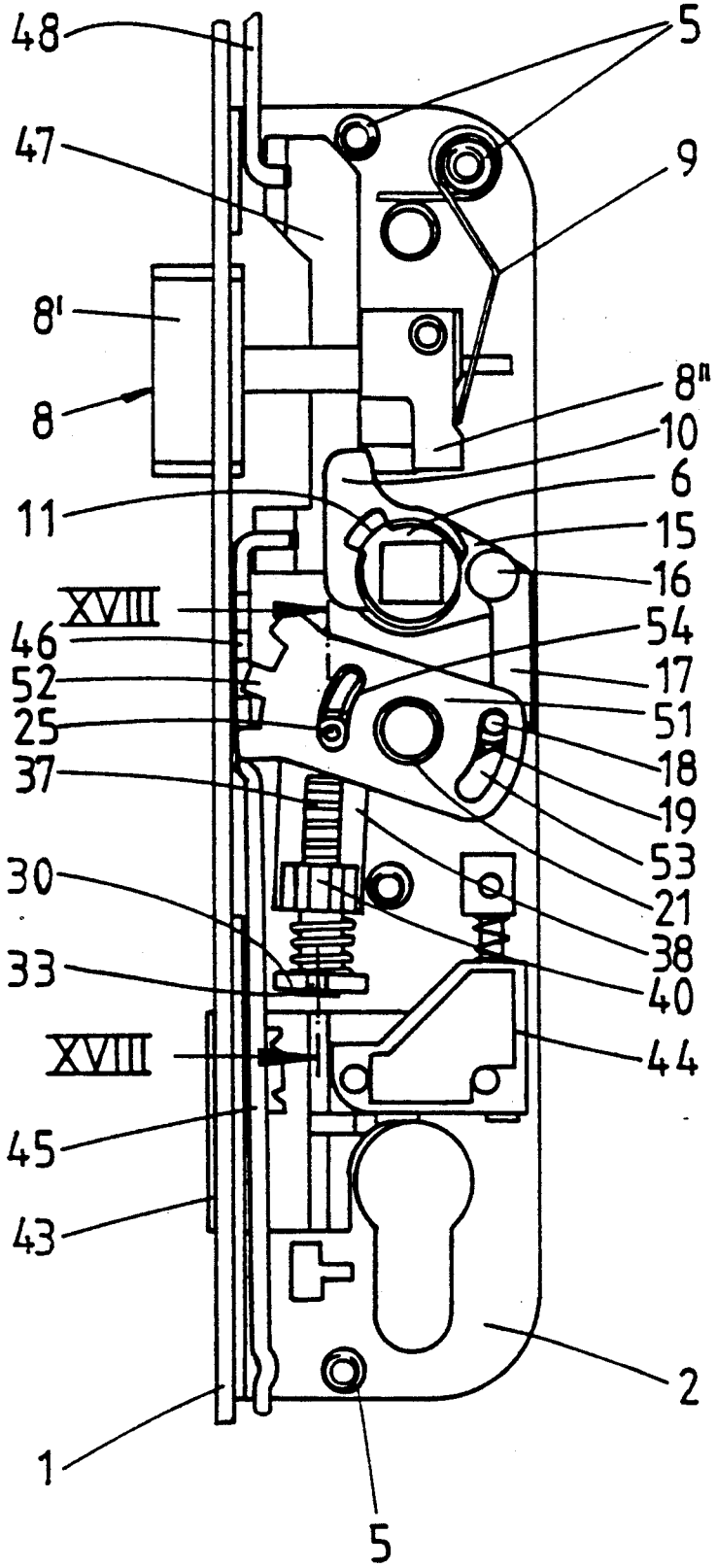
FIG. 3 is a detailed view of the drive-rod lock with the lock cover removed, looking at the lock ward in the position corresponding to the door open.
Figure 4:
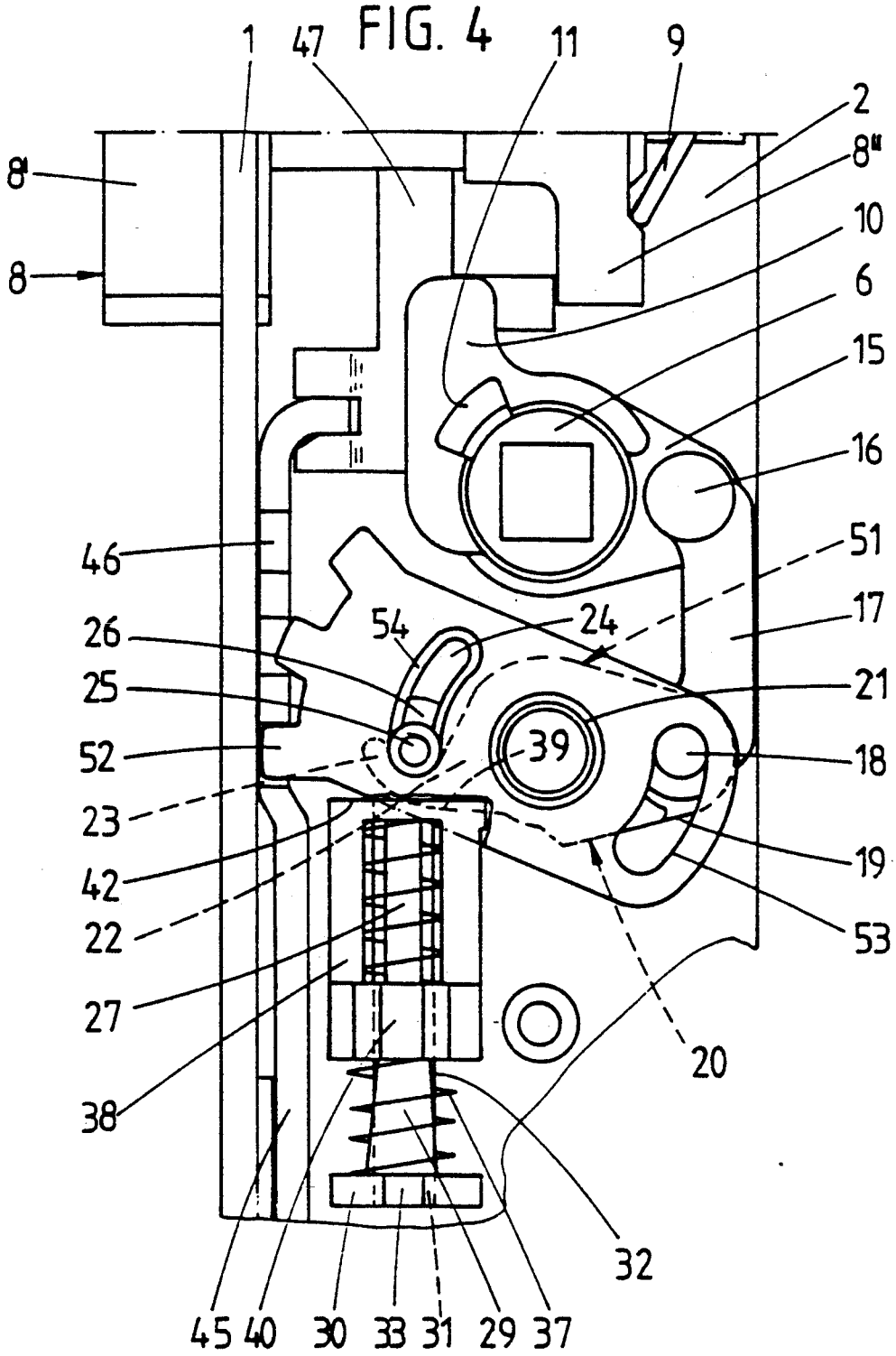
FIG. 4 shows, in enlarged detail, the structural unit which holds the nut in its basic central position, corresponding to the open position.
Figure 5:
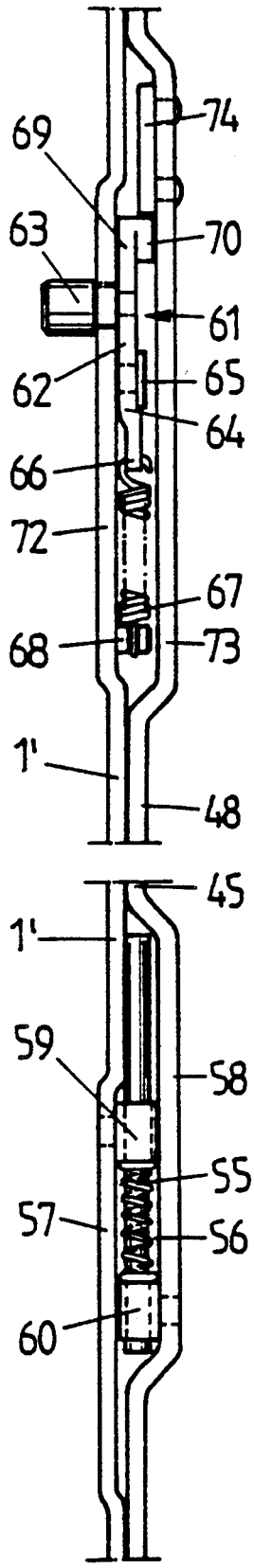
FIG. 5 is a side view of the cuff-rail sections in the region of the release and of the force accumulator corresponding to the door open, i.e. with the force accumulator loaded and secured.
Figure 6:
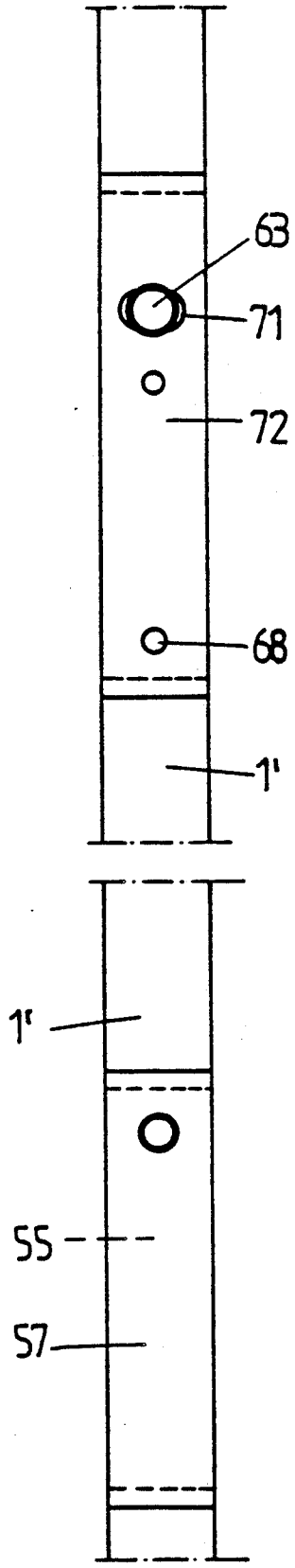
FIG. 6 is a rotated view thereof.
Figure 8:
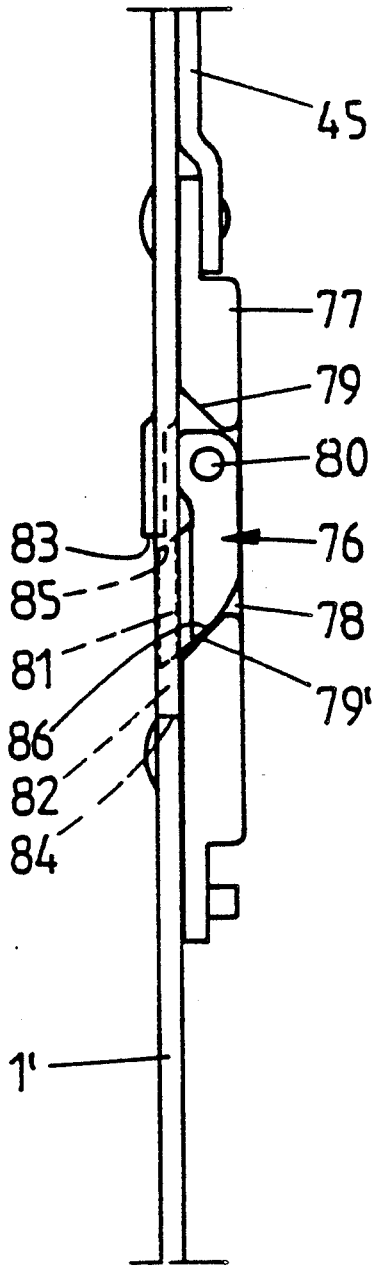
FIG. 8 is a view of the lower cuff-rail sections in the region of the locking member which is developed as swivel bolt, in the release position of the locking member.
Figure 9:
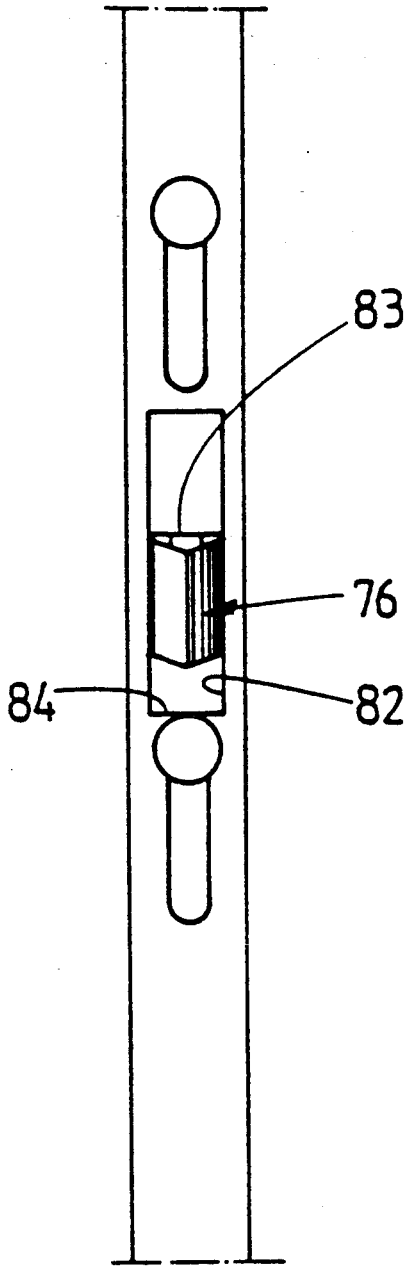
FIG. 9 is a rotated view thereof.

The drive-rod lock operates as follows:

If a door which has been equipped with the drive-rod lock of the invention is in its open position, then the drive-rod lock is in the position shown in FIGS. 3, 5 and 8. The force accumulator 55 is cocked but prevented from unloading by the detent device 61. The drive rods 45, 48 cannot move and push out the swivel bolts 76.

Figure 10:
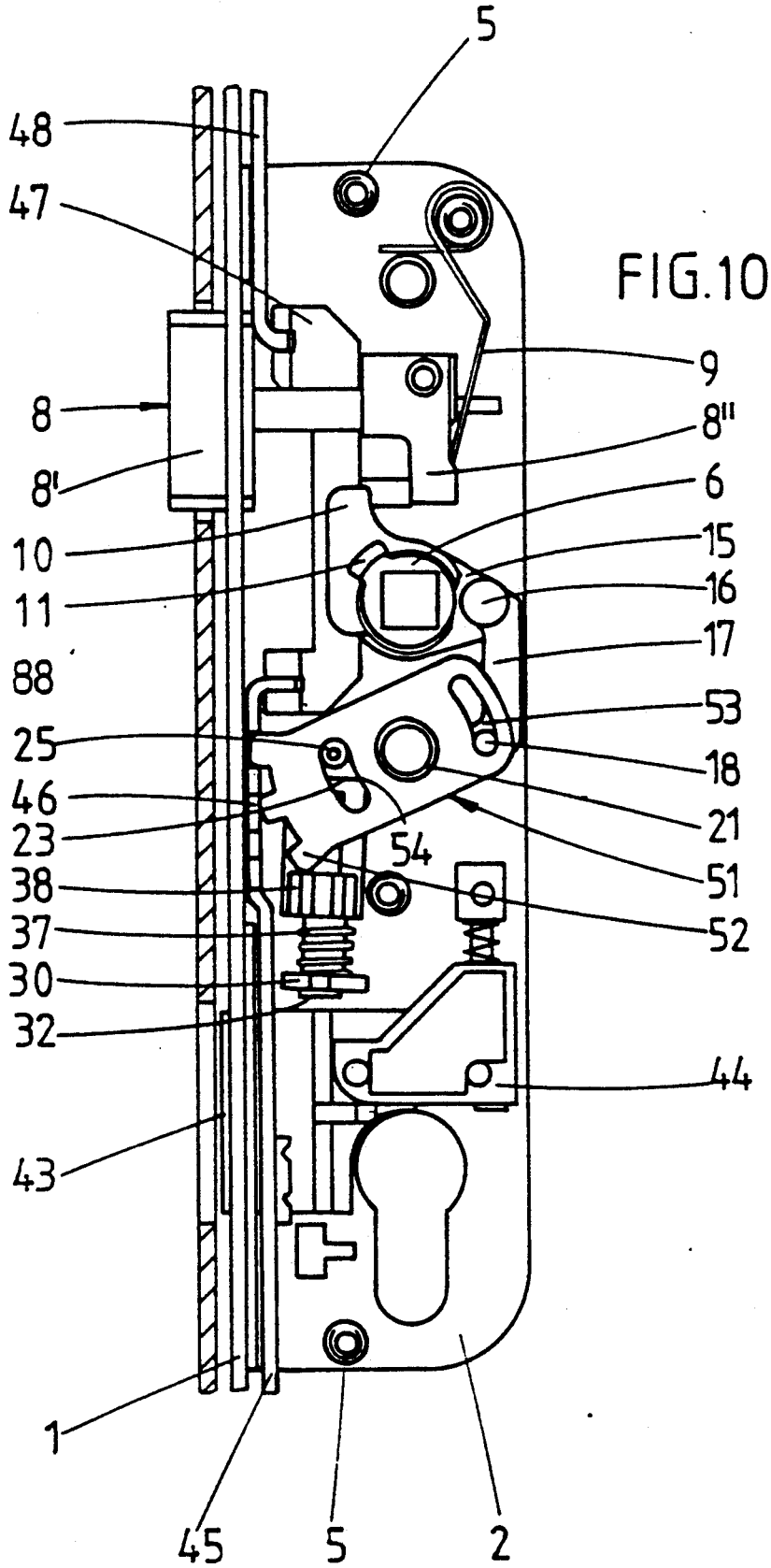
FIG. 10 is a view corresponding to FIG. 3 in which the door has been brought into the closed position, with the drive rods displaced.
Figure 11:
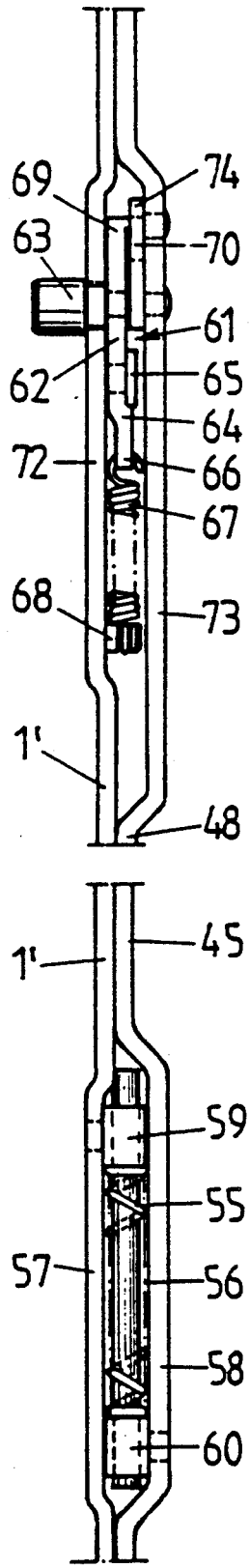
FIG. 11 is a view corresponding to FIG. 5, but with the force accumulator unloaded.
Figure 12:
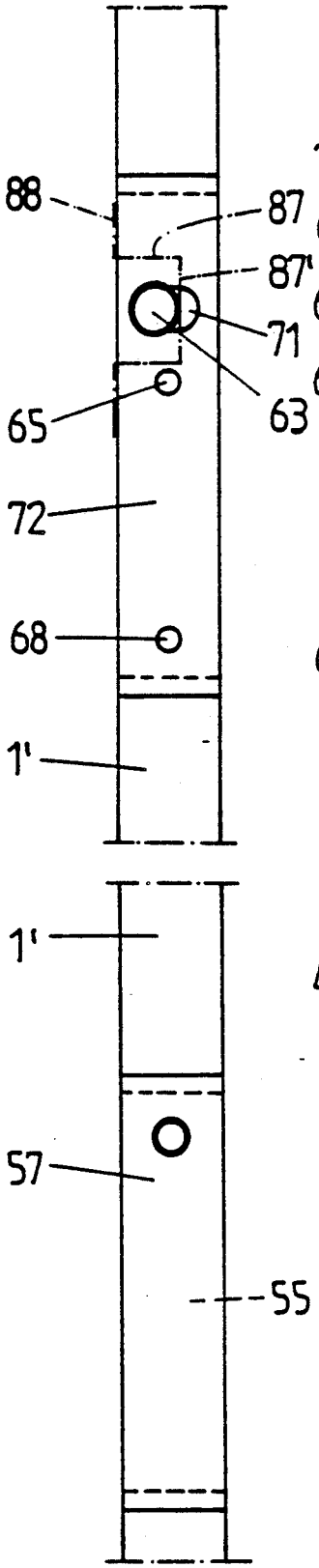
FIG. 12 is a view corresponding to FIG. 6 in which the release is acted on by the counter-lock part.
Figure 13:
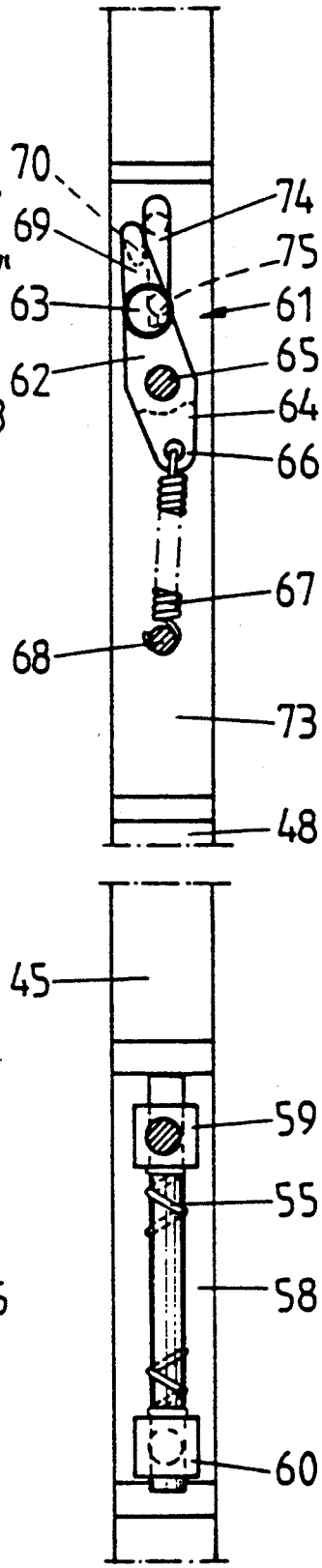
FIG. 13 is a view corresponding to FIG. 7, but with the release displaced.
Figure 14:
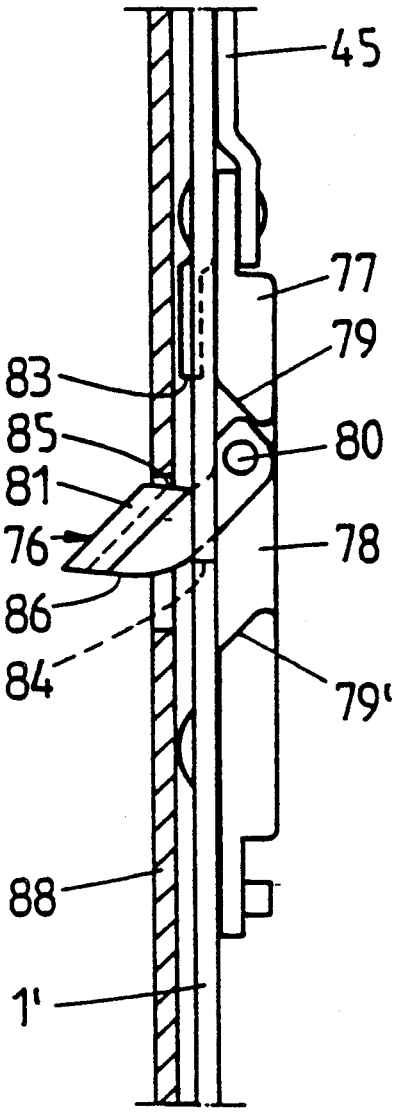
FIG. 14 shows the locking member in its locking position.
Figure 15:
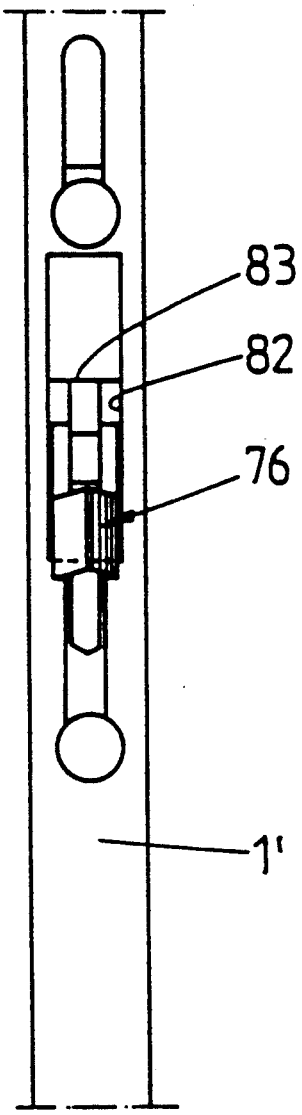
FIG. 15 shows the corresponding side view.

When the door is closed or pushed shut, the feeler member 63 of the release 62 moves through an entrance opening 87 in the strikeplate 88 on the side of the doorframe. In the final phase of the door-closing displacement, the feeler member 63 then strikes against the vertical edge 87', whereby the swing lever 64 is swung around its articulated pin 65. As a result, the projection 70, after overcoming a certain detent force, moves out of the throat 75 in the abutment 74 on the drive-rod side. The support is thus removed from the abutment 74, so that the force accumulator 55 can enter into action and unload, together with a downward movement of the drive rods 45, 48. The drive-rod lock then assumes the position shown in FIG. 10, while the detent device 61 and the force accumulator 55 enter into the position shown in FIG. 11. Together with the downward displacement of the drive rods 45, 48, the drivers 77 also displace the swivel bolts 76. The mating control surface 86 strikes against the transverse edge 84 of the outlet opening 82 and thereby forces an outward displacement of the swivel member 76. After closing the door, assurance is thus had that both the latch 8 and the locking members 76 are in engagement with the strikeplate 88 on the doorframe side, or have entered into the locking engagement openings present there. Warping of the door is thus counteracted. It is then possible in this position to advance the bolt 43 by means of a lock cylinder.

Figure 17:
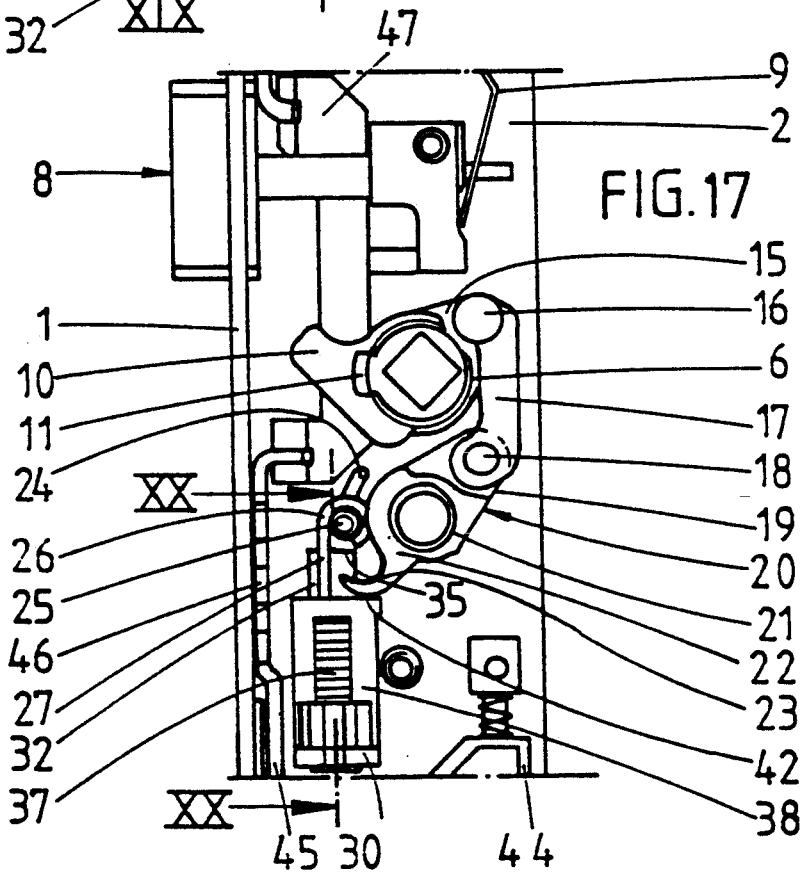
FIG. 17 shows a section of the drive-rod lock in the region of the nut, which is swung in counterclockwise direction, with simultaneous displacement of the drive rods and of the locking members controlled by them into the locking position.
Figure 18:
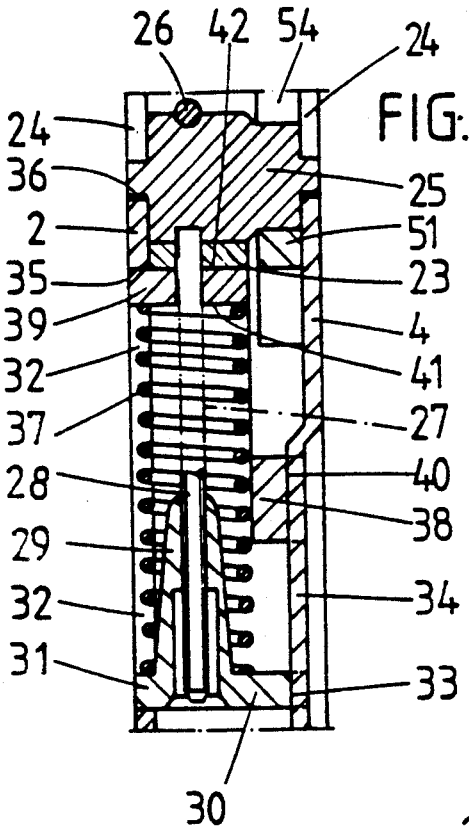
FIG. 18 is a section along the line XVIII—XVIII in FIG. 3.

If it was not possible, upon the closing of the door, for one or both locking members 76 to enter into their engagement openings, then the displacement of the drive rods 45, 48 is also blocked thereby. In that case, however, there is the possibility of supporting the force accumulator in the manner that the door handle 7 is displaced in counterclockwise direction into position III while positively carrying along the drive rods, together with an extending of the swivel bolts which enter with their roof-shaped engagement end into the corresponding engagement opening of the strikeplate 88. During this swinging motion, the nut 6 and the parts coupled with it pass into the position shown in FIG. 17. Via the link plate 17 and the actuating arm 20, the toothstrip segment 51 is immediately carried along, it moving the drive rod 45 and, via the drive-rod connecting piece, the other driver rod 48 downward. This swinging motion is limited by the stop edge 13 of the lock cover 4, against which the rotation-limiting stop 11 of the nut 6 strikes.

Figure 20:
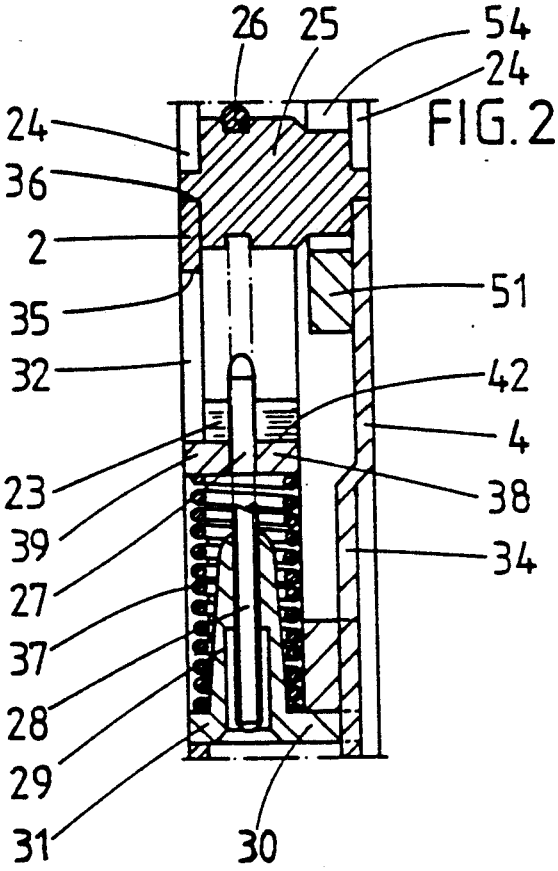
FIG. 20 is a section along the line XX—XX of FIG. 17.

By the swinging of the actuating arm 20, its claw-shaped end 23 acts on the end surface 42 of the slide 38 which moves downward against the force of the compression spring 37; see also FIG. 20. The coupling pin 25 against which the mandrel 27 and thus the auxiliary slide 30 rest remain in their position. If the door handle 7 is then released, the slide 38 returns under a spring action into its starting position, with simultaneous swinging of the actuating arm 20, which, via the link plate 17, returns the nut 6 and thus the door handle 7 into the basic central position. As a result of the arcuate slots 53, 54, the toothed segment 51 remains in place, so that the pivot pin 18 and the coupling pin 25 are then adjacent the opposite ends of the arcuate slots 53, 54.

Figure 16:
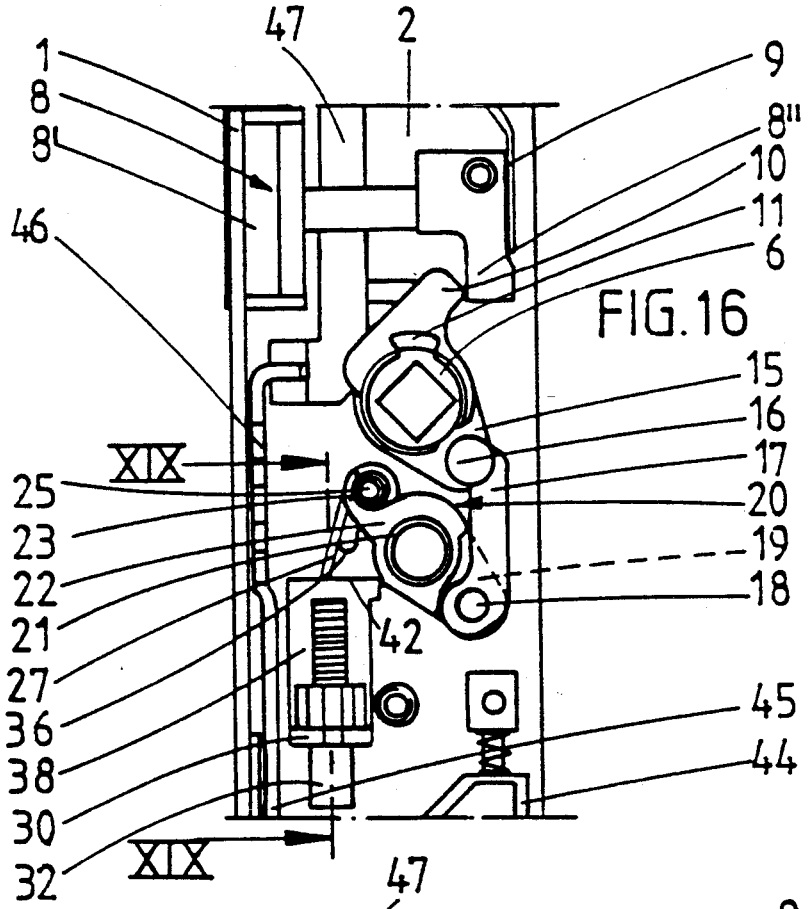
FIG. 16 shows the drive-rod lock in the region of the nut-side during the retraction of the latch and the loading of the force accumulator, with simultaneous upward displacement of the auxiliary slide.
Figure 19:
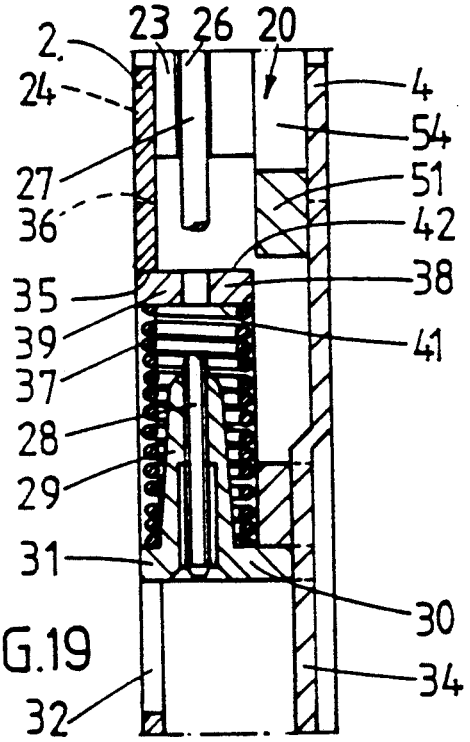
FIG. 19 is a section along the line XIX—XIX in FIG. 16.

If the bolt 43 has been advanced, the opening of the door requires that it be retracted. The door handle 7 must then be moved into position II, the lock ward passing into the position shown in FIGS. 16 and 19. By means of the nut 6, the latch 8 is retracted. Furthermore, the link plate 17 swings the actuating arm 20 whereby the auxiliary slide 30 moves via the mandrel 27 against the force of the compression spring 37 in upward direction. The slide 38 is supported, in its turn, on the opposing stop edge 35 of the longitudinal slot 32; see also FIG. 19. The toothed segment 51 is also carried along during this process. It comes to rest in its end position. Under the action of the compression spring 37, the arcuate slots 53, 54 then permit the swinging back of the actuating arm 20 and the nut 6 into the starting position shown in FIG. 3. The swinging toothed segment 51 has displaced the drive rods 45, 48. The force accumulator 55 is loaded thereby, while the swing lever 64, which is urged by spring in the direction of its central position, can enter with its projection 70 into the throat 75 of the abutment 74 and thus fixes this position of the drive rods. By the displacement of the drive rods 45, 48 and by cooperation of transverse edge 83 and mating control surface 85, the locking members 76 have been swung into their release position. The next locking process can then take place.

From the position shown in FIG. 3 the nut can at any time be retracted in clockwise direction by displacement of the door handle. In the process, the slide 38 is displaced by the actuating arm 20 against the force of the compression spring 37. As a result of the idle stroke, the toothed segment 51 is not carried along. The compression spring 37 then brings the above-mentioned structural parts back into their normal position. Upon such a closing of the door, the latch 8 is not displaced by the strikeplate on the frame side. The door can, in this way, be closed with little noise, the releasing of the force accumulator 55 again taking place in the final closing phase, together with an outward movement of the locking members 76.

The auxiliary slide 30, which can be screwed on the threaded section 28 of the mandrel 27, furthermore permits adjustment of the mandrel length and thus a corresponding adjustment of the initial tension of the compression spring 37.

We claim:

1. A drive-rod lock for use with a door in a door frame, the lock comprising drive rods, a door handle, means including a nut operatively engaged with the door handle for displacing the drive rods by a turning of the door handle, the nut being operative with the door handle wherein the nut, upon being held in its basic central position, is rotatable out of said position against an opposed spring action upon the turning of said door handle;

a lock case carrying a cuff rail which continues beyond the lock case into freely extending cuff-rail sections;

said drive rods being guided behind the cuff-rail sections;

means comprising at least one force accumulator acting on said drive rods, additional locking members and mating locking parts, the locking parts being disposed on a frame side of the lock, the additional locking members being arranged and controlled by said drive rods so as to enter into said mating locking parts both as a result of said turning of the door handle and as a result of a releasing of said at least one force accumulator;

means comprising a release actuated by a closing of the door for releasing the force accumulator; and wherein said release and/or the force accumulator are arranged behind the freely extending cuff-rail sections.

2. A drive-rod lock according to claim 1, wherein said cuff-rail sections and/or said drive rods are configured as bends in which the force accumulator is inserted, the force accumulator being configured as a compresssion spring.

3. A drive-rod lock according to claim 1, wherein said release comprises a swing lever which is pivotal from a central position corresponding to a blocking of the force accumulator towards either side of a longitudinal direction of the cuff-rail sections into a separate release position releasing the force accumulator.

4. A drive-rod lock according to claim 3, further comprising a tension spring and wherein said swing lever is pulled by said tension spring into a central position in which the swing lever is aligned with a longitudinal direction of the cuff-rail sections.

5. A drive-rod lock according to claim 1, further comprising an abutment seated on one of said drive rods; and wherein said swing lever has, at its free end, a projection directed transverse to its longitudinal direction for supporting insertion into a throat of said abutment seated on the drive rod.

6. A drive-rod lock according to claim 5, further comprising a tension spring, and wherein said swing lever is mounted on one of said cuff-rail section, and is developed with two lever arms with one of said lever arms forming said projection while the tension spring acts on the other lever arm.

7. A drive-rod lock according to claim 3, further comprising an arcuate slot in one of said cut-off rail sections; and wherein the feeler member is developed in pin-shape and passes through the arcuate slot, the slot being arranged concentric to a fulcrum of the swing lever.

8. A drive-rod lock according to claim 1, further comprising a first slide, an auxiliary slide, a coupling pin, a compression spring, and an actuating arm, the coupling pin being clamped by the compression spring against the actuating arm and being located between the actuating arm and the auxiliary slide intersecting the first slide; and wherein the actuating arm has a claw-shaped end, and the coupling pin clamps the claw-shaped end of the actuating arm against an end surface of the first slide; and the auxiliary slide has a mandrel, and the compression spring is seated on the mandrel of the auxiliary slide, the mandrel extending through the inside of the first slide and gripping over the coupling pin in the manner of a yoke.

9. A drive-rod lock according to claim 8, further comprising a lock housing having a slot in the housing, and stops in the slot; and wherein said first slide receives a part of a length of said compression spring, and said coupling pin is guided in a direction of said first slide, limited by said stops, in said slot of the lock housing; and a section of said housing has a stop edge, and an opposed counterstop edge which is operative with the slide, the stop edge being an edge of the slot.

10. A drive-rod lock according to claim 8, further comprising a link plate; and wherein said actuating arm is developed with a first arm and a second arm, the second arm being coupled to said nut via said link plate.

11. A drive-rod lock according to claim 8, wherein said compression spring is adjustable by adjustment of the length of said mandrel.

12. A drive-rod lock according to claim 5, further comprising a tension spring; and wherein in a secured, loaded position of the force accumulator, said abutment, said swing lever forming said release, and points of attack of the tension spring are arranged one behind the other in longitudinal direction.

13. A drive-rod lock for use with a door in a door frame, the lock comprising a door handle, a nut having an arm portion and being configured for receiving the door handle, drive rods and means coupled to said arm portion of said nut for activating said drive rods upon rotation of said nut, the drive rods being displaceable by a turning of the door handle, the nut being operative with the door handle wherein the nut, upon being held in its basic central position, is rotatable out of said position against an opposed spring action upon the turning of said door handle;

a lock case enclosing said activating means and bearing a cuff rail which continues beyond the lock case into freely extending cuff-rail sections, said drive rods being guided behind the cuff-rail sections;

at least one force accumulator disposed on one of said cuff-rail sections for acting on said drive rods, additional locking members and mating locking parts, each of the mating locking parts being stationary and having a recess with an inner surface positioned for engagement with corresponding ones of said additional locking members upon movement of said drive rods, the locking parts being disposed on a frame side of the lock, the additional locking members being controlled by said drive rods for entering into said mating locking parts and being deflected by said mating locking parts both as a result of the turning of the door handle and as a result of a releasing of said at least one force accumulator;

a release actuated by a closing of the door, the release comprising a swing lever and a feeler member extending from the lever in a direction parallel to an axis of pivot of the swing lever for engagement with a strikeplate of the door frame to free the swing lever for rotation, the releasing of the force accumulator being effected by means of said release; and wherein the release and/or the force accumulator are arranged behind the freely extending cuff-rail sections.

* * * * *